US012005316B2

(12) United States Patent
Berg

(10) Patent No.: US 12,005,316 B2
(45) Date of Patent: Jun. 11, 2024

(54) BARBELL WITH INTEGRATED SENSOR

(71) Applicant: Eleiko Group AB, Halmstad (SE)

(72) Inventor: Stefan Berg, Halmstad (SE)

(73) Assignee: ELEIKO GROUP AB, Halmstad (SE)

( * ) Notice: Subject to any disclaimer, the term of this patent is extended or adjusted under 35 U.S.C. 154(b) by 354 days.

(21) Appl. No.: 17/602,508

(22) PCT Filed: Mar. 26, 2020

(86) PCT No.: PCT/SE2020/050310
§ 371 (c)(1),
(2) Date: Oct. 8, 2021

(87) PCT Pub. No.: WO2020/209772
PCT Pub. Date: Oct. 15, 2020

(65) Prior Publication Data

US 2022/0161096 A1 May 26, 2022

(30) Foreign Application Priority Data

Apr. 12, 2019 (SE) ..... 1950460-4

(51) Int. Cl.
*A63B 24/00* (2006.01)
*A63B 21/072* (2006.01)
*A63B 21/075* (2006.01)

(52) U.S. Cl.
CPC ..... *A63B 24/0062* (2013.01); *A63B 21/0724* (2013.01); *A63B 24/0084* (2013.01);
(Continued)

(58) Field of Classification Search
CPC ..... A63B 21/0724; A63B 21/075; A63B 24/0062; A63B 24/0084; A63B 71/0622;
(Continued)

(56) References Cited

U.S. PATENT DOCUMENTS 9,789,360 B1 10/2017 Schaffer
10,458,838 B2 * 10/2019 Lee ..... A63B 21/0728
(Continued)

FOREIGN PATENT DOCUMENTS

CN 206964991 U 2/2018
CN 108635739 A 10/2018
(Continued)

OTHER PUBLICATIONS

International Search Report from corresponding International Application No. PCT/SE2020/050310, dated May 27, 2020, 4 pages.

*Primary Examiner* — Megan Anderson
(74) *Attorney, Agent, or Firm* — Tucker Ellis LLP

(57) ABSTRACT

Disclosed is a smart barbell (1) which comprises a first bar part (10) and a second bar part (20), each arranged for carrying one or more weights, the first bar part (10) and the second bar part (20) extends along a longitudinal axis (X-X). The barbell (1) further comprises a central bar part (30) arranged between the first and the second bar parts (10, 20) and which is connected to the first bar part (10) and the second bar part (20) and extends along the longitudinal axis (X-X). At least one of the first bar part (10) and the second bar part (20) comprises a cavity (12, 22), in which at least one sensor (40, 50) is arranged for registration of movements of the barbell (1) and for wireless communication with a data analyzing unit (100).

8 Claims, 3 Drawing Sheets

(52) U.S. Cl.
CPC ..... *A63B 21/075* (2013.01); *A63B 2209/08* (2013.01); *A63B 2220/80* (2013.01); *A63B 2220/803* (2013.01); *A63B 2220/833* (2013.01); *A63B 2225/50* (2013.01)

(58) Field of Classification Search
CPC ..... A63B 2209/08; A63B 2225/50; A63B 2220/80; A63B 2220/803; A63B 2220/8033; A63B 2220/017
See application file for complete search history.

(56) References Cited

U.S. PATENT DOCUMENTS

| | | | | |
|---|---|---|---|---|
| 11,135,477 | B1 * | 10/2021 | Kneknas | G01B 21/24 |
| 2013/0090212 | A1 | 4/2013 | Wang | |
| 2014/0235409 | A1 | 8/2014 | Salmon et al. | |
| 2016/0310789 | A1 | 10/2016 | Emerson | |
| 2017/0216665 | A1 | 8/2017 | Mahr | |
| 2018/0056127 | A1 | 3/2018 | Den Hollander et al. | |
| 2018/0156657 | A1 | 6/2018 | Lee | |
| 2020/0009442 | A1 * | 1/2020 | Kasabdji Raffensperger | A63B 71/0622 |
| 2023/0086790 | A1 * | 3/2023 | Breaux | G01G 19/52 482/8 |

FOREIGN PATENT DOCUMENTS

| | | | |
|---|---|---|---|
| JP | 2000237364 | A | 9/2000 |
| JP | 2015000206 | A | 1/2015 |

* cited by examiner

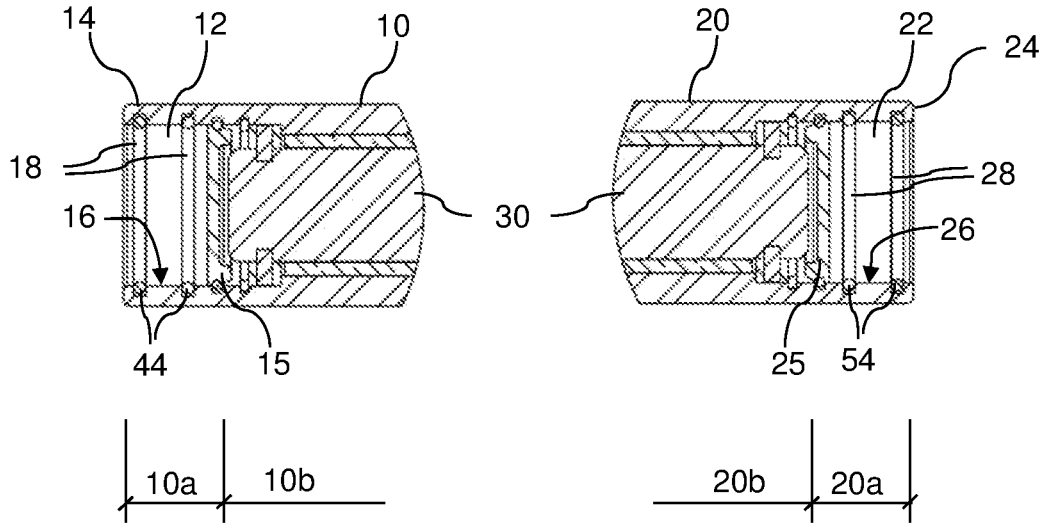
Fig. 2a-b
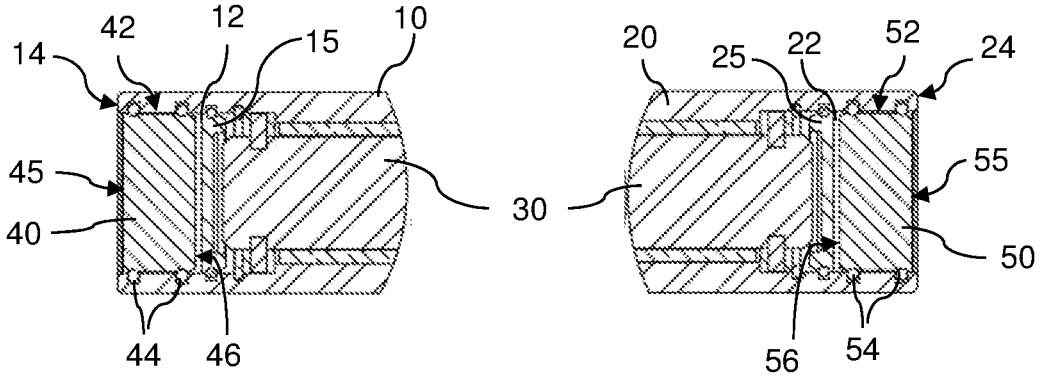
Fig. 2c-d

BARBELL WITH INTEGRATED SENSOR

TECHNICAL FIELD

The invention considers a smart barbell which comprises at least one integrated sensor arranged for registration of movements of the barbell and for wireless communication with a data analyzing unit.

BACKGROUND ART

Recently, commercial products for tracking motions of weight lifting equipment has reached the market. Typically, a sensor is attached to the outside of the equipment, for example to the outside of a barbell or a dumbbell, in a position on the equipment which is hopefully out of way for the athlete. The motion may also be recorded with cameras and the motion may be analyzed by different kinds of analyzing programs, designed for computers or tablets or the like. Data like speed, acceleration, deviations of the motion relative the vertical plane etc. is recorded. By this relatively new technique, the athlete may evaluate his or her technique during the exercise and develop the technique further. Another aspect is also to have interesting data to present for the audience at competitions and for the audience watching TV. In the future, the technique may also be used to support competition referees as well. Since prior art solutions only use one sensor in one position on for example a barbell, the motion may only be analyzed in one dimension at the time, for example from the front or from the side. For weight-lifting with barbells, also the tracking of the complete barbell would be interesting, that is the tracking also of the barbell in relation to for example the horizontal plane or the like, to analyze if the athlete raises the bar in a stable and horizontal motion or if the motion is wobly and not horizontal. A straight-forward solution to that would be to attach one more sensor on the outside of the barbell and spread the sensors a bit along the barbell. As mentioned above, the drawbacks are that the sensors may disturb the athlete since they are positioned on the outside of the barbell and they are also vulnerable and may be destroyed since they may hit other equipment or even fall off the barbell during the handling of the barbell. Another aspect is the esthetic aspect when it comes to broadcasted professional competitions—visible sensors just don't look that nice on TV.

SUMMARY OF THE INVENTION

It is an object of the invention to address at least some of the problems and issues outlined above. It is possible to achieve these objects and others by a barbell as defined in the attached independent claims.

According to an aspect of the invention, a barbell comprises a first bar part and a second bar part, each arranged for carrying one or more weights, and the first bar part and the second bar part extends along a common longitudinal axis. Between the first and the second bar parts is a central bar part arranged and which is connected to the first bar part and the second bar part and extends along the longitudinal axis. At least one of the first bar part and the second bar part comprises a cavity. Further, at least one sensor arranged for registration of movements of the barbell and for wireless communication with a data analyzing unit, is arranged in the cavity.

By this design, the sensor is integrated in the barbell which is an advantage since an integrated sensor is out of way and out of sight of the user and does not disturb for example a competitor during a competition. Prior art sensors are used as one individual sensor mounted on any location on the outside of the barbell, why this kind of sensor may disturb the user and easier fall off the barbell during the use of the barbell. By the integration of the sensor as a part of the barbell, a well-protected and hidden sensor solution is achieved for the ability to track the motion of the barbell during training or competition, which is not known in prior art.

According to an embodiment, the first bar part comprises a first cavity and the second bar part comprises a second cavity and the at least one sensor comprises a first sensor arranged in the first cavity and a second sensor arranged in the second cavity. So, the barbell comprises one sensor in each of the two bar parts (first and second), which bar parts normally are the end parts between which the central bar part is connected. By letting both the first and the second bar parts (bar part ends) comprise a cavity and one sensor each, a lot more high precision data may be tracked, analyzed and maybe displayed during training and/or competition. Since a barbell has a length extension, one sensor applied in a respective cavity at the respective barbell end parts (first and second) which ends normally (but not necessary) carrying the weights, provides a better and more precise data recording and analyzing of the motion of the barbell during the exercise, but still with an integrated design without any disturbances of the user. Since prior art only provides one sensor and a visible position, the known art is not good enough, especially when it comes to professional weight lifting competitions and the analyzing and the display of the result, for example when broadcasting the competitions on television.

According to an embodiment, the first bar part extends between a first end connected to the central bar part and a free second end, and the second bar part extends between a first end connected to the central bar part and free second end, and the cavity is arranged at the free second end of the first and/or second bar part. This positioning is especially good since two sensors, positioned a distance far from each other render better data, both according the motion of the barbell in one or more planes, but also for calibration reasons and precision reasons. Further, the positioning of the integrated sensor near an end means better Wi-Fi—, Bluetooth—or similar communication with the data analyzing unit.

According to an embodiment, the at least one of the first bar part and the second bar part is a hollow tube, and the central bar part extends into the hollow tube a distance that is shorter than a length of the hollow tube and thereby leaves a free space at the free second end of the hollow tube, wherein the free space constitutes the cavity for the at least one sensor. Normally, the central part, i.e. the grip part of the barbell is narrower than the first and second bar parts (end parts) which carrying the weights. The central bar part may be fixedly fitted into a hollow tube part which in that case is arranged for carrying the weights, and further may have bearings or bushings between the central bar part and the end part (first and/or second bar part), to minimize noise and vibrations as well as minimize wear. By letting the central bar part extend into the hollow tube a distance that is shorter than a length of the hollow tube, the free space at the end of the hollow tube is available for the sensor, which means no or a minimal cost added to the production cost of the complete barbell. A simple and cost efficient solution for a barbell with integrated sensors is thereby achieved.

According to an embodiment, the depth of the cavity, seen along the longitudinal axis, exceeds a height of the sensor such that the sensor fits inside the cavity and thereby is protected inside the cavity. This means that the cavity is deep enough to totally include the sensor inside the cavity, i.e. inside the barbell, and thereby the sensor is protected from external damage. Typically, the sensor is insertable from the free end of the first and/or second bar part to a depth that is deep enough to gain protection from the cavity walls (first and second bar part walls) which protrudes a distance outside the end of the sensor when inserted. The sensor is thereby totally protected while prior art solutions may fall off, be damaged etc. due to the fact that they are exposed on the bar.

In yet an embodiment, an enclosing side surface of the sensor faces an interior sidewall of the cavity and the enclosing surface of the sensor is arranged to engage with the interior sidewall of the cavity for retaining the sensor in the cavity.

According to an embodiment, the interior sidewall of the cavity comprises at least one recess arranged for at least one seal and the enclosing surface of the sensor, or the at least one recess of the interior sidewall of the cavity, is arranged with the at least one seal, for retaining the sensor in the cavity. By such a solution, the sensor is kept in by friction engagement between the seal and the surface of the sensor or the surface of the interior sidewall, depending on where the seal is arranged. The sensor is preferably dimensionally coordinated with the inside dimensions of the cavity, such as it is easy enough to insert in the cavity but adapted to have enough friction between the seal and surrounding surfaces to hold the sensor inside the cavity, but easy enough also to pull it out from the cavity. Even more preferred is to use two seals positioned at an axial distance from each other, either in a respective recess in the interior sidewall or in two positions along the enclosing surface of the sensor, to provide a good enough holding of the sensor inside the cavity. This seal solution discloses an easy assemble of the sensor at the same time as a protected position in the cavity, without any risk that the sensor will fall off the barbell or be damaged as in prior art solutions.

According to an alternative embodiment, the sensor is arranged for threaded engagement with the interior sidewall of the cavity by that the enclosing surface of the sensor is arranged with a first thread and the interior sidewall of the cavity comprises a corresponding second thread, arranged for cooperation with the first thread of the sensor. This is also a robust, quick and safe solution for holding the sensor in the cavity and protect the same from external impact and to hide the sensor to not disturb the athlete.

According to yet an alternative embodiment, the sensor is retained in the cavity by a magnet and corresponding magnetic material, wherein either a bottom of the sensor or a bottom of the cavity comprises the magnet, and the one of the bottom of the sensor or the bottom of the cavity that not comprises the magnet, comprises the magnetic material. For example, the cavity may comprise a metal cap as a bottom of the cavity. The metal cap may function as a divider between the free end cavity (comprising the sensor) and the cavity containing the central bar, for example when the first bar part and the second bar part are made of hollow tubes, into which the central bar part is fixed as described above. Thus, by having a magnet in at least a center of the bottom of the sensor, and a metal bottom/divider of the cavity, a magnetic holding of the sensor is achieved. This enables a quick and easy mounting and dismounting of the sensor in the barbell end.

According to an alternative embodiment, the sensor is arranged for bayonet engagement with the interior sidewall of the cavity by that the enclosing surface of the sensor is arranged with first bayonet means and the interior sidewall of the cavity comprises a corresponding second bayonet means arranged for cooperation with the first bayonet means of the sensor. A bayonet engagement between the cavity wall and the sensor also enables a quick and easy mounting of the sensor in the barbell end. An alternative solution would also be some kind of snap connection with a release of the snap connection, for example with a tool, but the bayonet solution, the threaded solution and the seal solution described above enables dismounting of the sensor without a tool if wanted.

According to an embodiment, the sensor comprises grooves at an outer end, which is opposite a bottom of the sensor. The grooves are arranged for cooperation with a dismounting tool for dismounting of the sensor from the cavity. If the sensor is to be totally "invisibly" mounted in the cavity it may be convenient to use a tool to dismount the sensor from the barbell. That's why the sensor may comprise grooves for engagement with a tool, whereas the tool is inserted into the grooves and then for example twisted a little to engage with groove edges of the groove. After this, the sensor may be pulled out from the cavity if the seal solution is used or unscrewed if the threaded or bayonet solution is used. By this, a barbell with a totally protected and invisible positioning of the sensor in the barbell is achieved.

Further possible features and benefits of this solution will become apparent from the detailed description below.

BRIEF DESCRIPTION OF DRAWINGS

The solution will now be described in more detail by means of exemplary embodiments and with reference to the accompanying drawings, in which:

FIG. 2*a-b* are section views of the barbell ends arranged with a cavity for the sensor.

FIG. 2*c-d* are section views of the barbell ends arranged with a sensor in each cavity.

DETAILED DESCRIPTION

Briefly described, a barbell with at least one integrated sensor is provided, which barbell comprises at least one protected and for the athlete invisible sensor for registration of movements of the barbell and for wireless communication with a data analyzing unit.

Figure 1A:
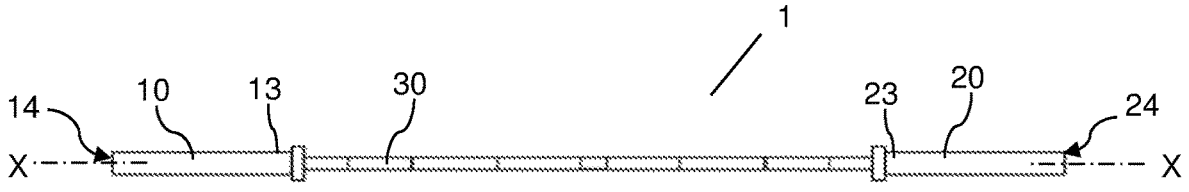
FIG. 1*a* is a front view of a barbell according to the invention.
Figure 1B:
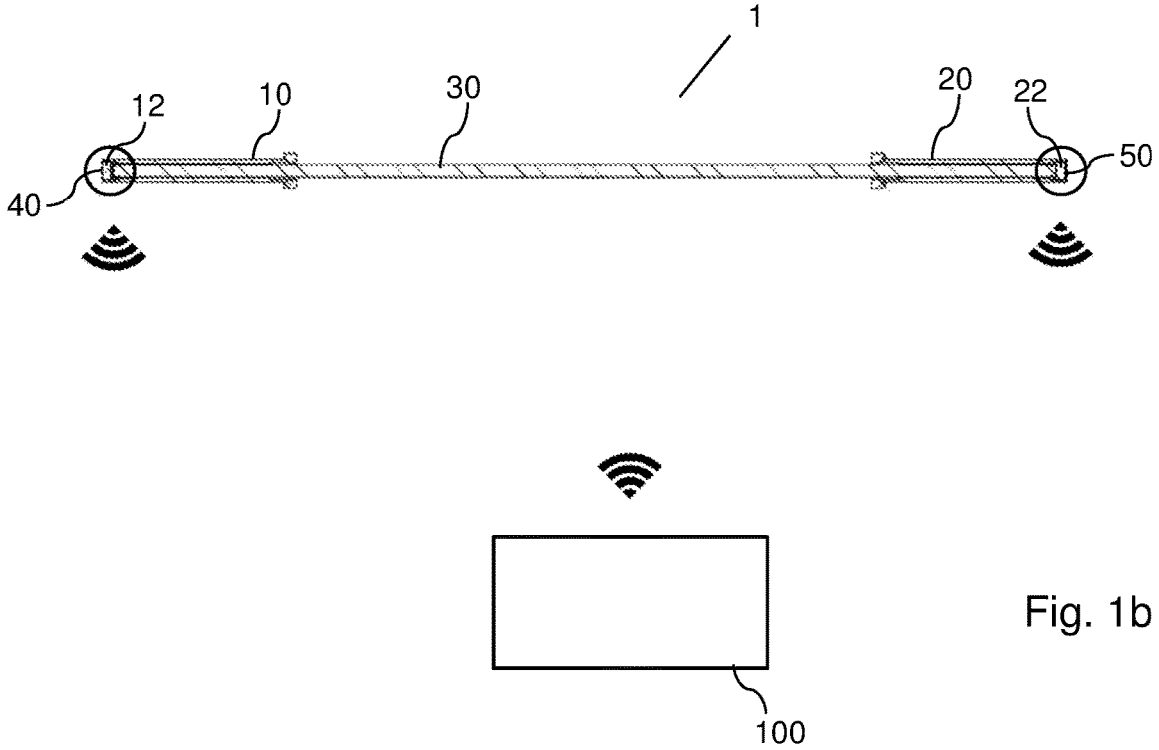
FIG. 1*b* is a section view of the barbell of FIG. 1*a* with integrated sensors at the barbell ends, which sensors communicates with a data analyzing unit.

FIG. 1*a-b* shows a barbell 1 in a front view (FIG. 1*a*) and a section view (FIG. 1*b*), which barbell 1 communicates with a data analyzing unit 100 via a communication protocol like for example Wi-Fi, Bluetooth or the like. The barbell 1 comprises a first bar part 10 and a second bar part 20 distal from the first bar part 10 and which are each arranged for carrying one or more weights (not visible). The first and second bar parts 10, 20 extends along a common longitudinal axis and between the first and the second bar parts 10, 20 is a central bar part 30 arranged. The latter is connected to the first bar part 10 and the second bar part 20 and extends in the preferred embodiment along the longitudinal axis X-X. The barbell 1 could of coarse be a so-called open barbell which has a central part 30 arranged with an offset from the longitudinal axis X-X for allowing an athlete to stand "in-line" with the longitudinal axis X-X. The preferred and here described embodiment is however a straight barbell 1 with a common longitudinal axis X-X. In the preferred embodiment, both the first bar part 10 comprises a first cavity 12 and the second bar part 20 comprises a second cavity 22. Further, a first sensor 40 is arranged in the first cavity 12 and a second sensor 50 is arranged in the second cavity 22. The sensors 40, 50 are arranged for registration of movements of the barbell and for wireless communication with a data analyzing unit 100. The first bar part 10 extends between a first end 13 which is connected to the central bar part 30 and a free second end 14. In the same way, the second bar part 20 extends between a first end 23 which is connected to the central bar part 30 and free second end 24. Further, the first bar part 10 and the second bar part 20 are hollow tubes, and the central bar part 30 extends into the respective hollow tube 10, 20 a distance that is shorter than a length of the hollow tube 10, 20 and thereby leaves a free space at the free second ends 14, 24 of the respective hollow tubes 10, 20. The free space constituting the first and the second cavity 12, 22 for the first and second sensor 40, 50 respectively.

The first and second sensors 40, 50 each comprises a transmitter and receiver for wireless transmitting and receiving of electronic signals over a communication protocol like Wi-Fi, Bluetooth or the like. The first and second sensor 40, 50 also each comprises a battery and a processor (not visible) wherein the battery provides power to the processor and the processor controls the function of the transmitter and receiver. The data analyzing unit 100 also comprises corresponding transmitter and receiver for wireless transmitting and receiving of electronic signals. As mentioned above, the data analyzing unit 100 may be a computer, a cell phone, a tablet or the like and preferably the data analyzing unit comprises an interface for displaying and analyzing the data and for interaction with the program. For example, if the load on the barbell is specified, a calculation of barbell kinematics and kinetics of the center of the barbell may be performed and displayed, this with high precision since data from two synchronized sensors is used to analyze the "midpoint" motion. Further, since two sensors are used, also the difference between the two ends may be calculated and tracked, by calculating and presenting the data of the two ends individually. All values may be calculated and presented in real time and the values may be presented on any kind of device, for example, computers, cell phones, tablets etc. Since the first and the second sensor 40, 50 each comprises a battery which is to be charged from time to time, it is an advantage that the sensors 40, 50 are dismountable from the barbell 1, which will be explained below.

FIG. 2*a-b* are section views of an end of the first bar part 10 to the left and an end of the second bar part 20 to the right. As mentioned above, the first bar part 10 and the second bar part 20 are hollow tubes, and as seen in the figures, the central bar part 30 extends into the respective hollow tube 10, 20 a distance that is shorter than a length of the hollow tube 10, 20.

Relating to the first bar part 10, this means that a short distance 10*a* of the tubular first bar part 10 is available at the second free end 14 of the first bar part 10, which free space comprises the first cavity 12. The short distance 10*a* of the tubular first bar part 10 is divided from a longer distance 10*b* of the tubular first bar part 10, by a first divider 15. The first divider 15 thereby constitutes a bottom of the first cavity 12. An interior sidewall 16 of the first cavity 12 comprises two recesses 18 arranged around the circumference of the interior sidewall 16 at a distance from each other along the longitudinal axis X-X. Both recesses 18 comprise one seal 44 each, which are arranged to guide the first sensor 40 to a correct positioning inside the first cavity 12 as well as retaining the first sensor 40 in the first cavity 12 by friction force between the interior sidewall 16/the seals 44 and the outside of the first sensor 40 (see description below). Further, different bearings and/or bushings may be seen around the end of the central bar part 30, for fixation of the same in the tubular first bar part 10.

Relating to the second bar part 20, a short distance 20*a* of the tubular second bar part 20 is available at the second free end 24 of the second bar part 20, which free space comprises the second cavity 22. The short distance 20*a* of the tubular second bar part 20 is divided from a longer distance 20*b* of the tubular second bar part 20, by a second divider 25. The second divider 25 thereby constitutes a bottom of the second cavity 22. An interior sidewall 26 of the second cavity 22 comprises two recesses 28 arranged around the circumference of the interior sidewall 26 at a distance from each other along the longitudinal axis X-X. Both recesses 28 comprise one seal 54 each, which are arranged to guide the second sensor 50 to a correct positioning inside the second cavity 22 as well as retaining the second sensor 50 in the second cavity 22 by friction force between the interior sidewall 26/seals 54 and the outside of the second sensor 50 (see description below). In the same way as described above regarding the first bar part 10, different bearings and/or bushings may be seen around the end of the central bar part 30, for fixation of the same in the tubular second bar part 20.

FIG. 2*c-d* are section views of an end of the first bar part 10 to the left, with the first sensor 40 inserted into the first cavity 12. To the right is an end of the second bar part 20 with the second sensor 50 inserted into the second cavity 22.

Relating to the first bar part 10, the first sensor 40 is in FIG. 2*c* (to the left) inserted into the first cavity 12 from the free second end 14, such as a bottom 46 of the first sensor 40 is close to the first divider 15 and an opposite outer end 45 of the first sensor 40 is just inside the free second end 14 such as the sidewalls protrudes a bit outside the first sensor 40. In other words, the depth of the first cavity 12, along the longitudinal axis X-X, exceeds a height of the first sensor 40 such that the first sensor 40 fits inside the first cavity 12, and thereby the first sensor 40 is protected inside the first cavity 12. An enclosing first side surface 42 of the first sensor 40 faces the interior sidewall 16 of the first cavity 12, and the enclosing surface 42 engages with the interior sidewall 16, i.e. the seals 44 of the first cavity 12, for retaining the first sensor 40 in the first cavity 12.

Relating to the second bar part 20, the second sensor 50 is in FIG. 2*d* (to the right) inserted into the second cavity 22 from the free second end 24, such as a bottom 56 of the second sensor 50 is close to the second divider 25 and an opposite outer end 55 of the second sensor 50 is just inside the free second end 24 such as the sidewalls protrudes a bit outside the second sensor 50. In the same way as described above regarding the first bar part 10, the depth of the second cavity 22, along the longitudinal axis X-X, exceeds a height of the second sensor 50 such that the second sensor 50 fits inside the second cavity 22, and thereby the second sensor 50 is protected inside the second cavity 22. An enclosing second side surface 52 of the second sensor 50 faces the interior sidewall 26 of the second cavity 22, and the enclosing surface 52 engages with the interior sidewall 26, i.e. the seals 54 of the second cavity 22, for retaining the second sensor 50 in the second cavity 22.

The first and second sensors 40, 50 are as said above positioned just inside the ends of the first and second bar part 10, 20 of at least two reasons. The first is as already discussed above, to protect the sensor inside the barbell 1. The second reason is the importance to keep the sensors 40, 50 as near the ends of the barbell 1 as possible, to achieve the best antenna performance/communication performance. That's why the electronics needs to be as close to the end of the barbell 1 as possible.

Figure 3A:
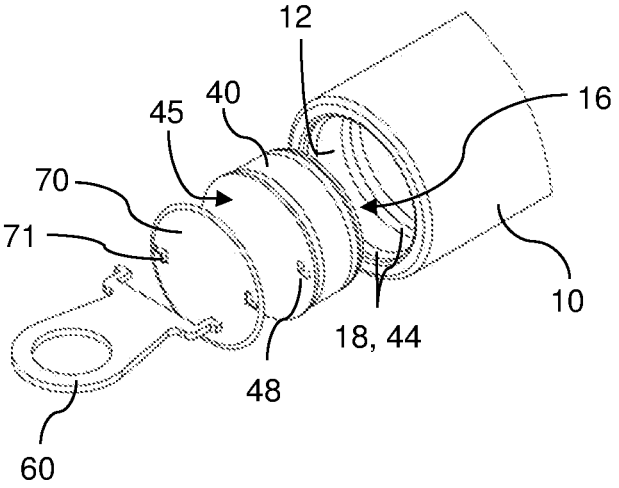
FIG. 3*a* is an exploded view of the barbell end of FIG. 2*c* and a tool for pulling out the sensor from the cavity of the barbell end.

FIG. 3*a* is an exploded view of the first bar part 10, but the second bar part 20 is a "copy" of the first bar part 10. In the figure, the first bar part 10 with its first cavity 12 is visible. The interior sidewall 16 of the first cavity 12 comprises the two recesses 18 which in turn each comprises one seal 44. The first cavity 12 is as told before arranged for the first sensor 40, which in the figure is just about to be inserted into the first cavity 12. Since the sensors 40, 50 are battery powered, it is an advantage to be able to quick and easy mount and dismount the sensors 40, 50 to/from the barbell 1, to for example unplugging and charging the sensors 40, 50. To facilitate this, the first sensor 40 as well as the second sensor 50 comprises grooves 48 at an outer end 45 which is opposite the bottom 46 of the sensor 40, which grooves 48 are arranged for cooperation with a dismounting tool 60, for the dismounting of the sensor 40 from the first cavity 12. In the preferred embodiment, a first end cap 70 is covering the first sensor 40 in its mounted position inside the first cavity 12, which first end cap 70 comprises corresponding through holes 71 arranged for the dismounting tool 60 to reach and engage with the grooves 48.

Figure 3B:
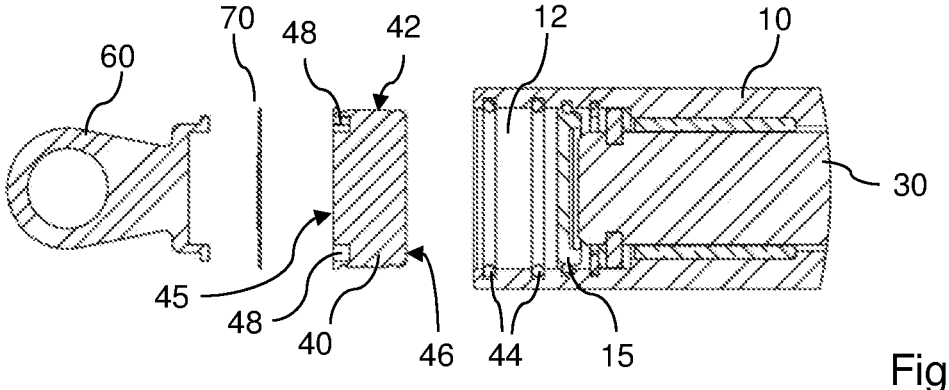
FIG. 3*b* is a section view of the exploded view of FIG. 3*a*.

FIG. 3*b* is a section view of the first bar part 10 presented in FIG. 3*a*. The most preferred embodiment is the alternative presented above, in which the first and the second cavity 12, 22 comprises recesses 18, 28 with seals 44, 54, for the easy mounting and dismounting of the sensors 40, 50 in combination with a tool 60. One option could of course be to skip the tool and replace it with some kind of handle or the like on the outer ends 45, 55 of the sensors 40, 50. An enclosing side surface 42 of the first sensor 40 faces the interior sidewall 16 of the cavity 12 when the first sensor 40 is arranged in the first cavity 12. The enclosing surface 42 is arranged to engage with the interior sidewall 16 of the cavity 12 or the seals 44, for retaining the first sensor 40 in the cavity 12. As may be seen in the figure, also the enclosing side surface of the first sensor 40 may comprise shallow recesses arranged for engaging with the seals 44, and thus provide a positioning of the first sensor 40 in the first cavity 12. As understood, all features described above regarding the first bar part 10 with the first sensor 40 is also applicable on the second bar part 20 with the second sensor 50 etc.

A number of other possible engaging possibilities between the sensors 40, 50 and interior sidewalls 16, 26 of the cavities 12, 22 are also possible. For example may the sensors 40, 50 be arranged for threaded engagement with the interior sidewalls 16, 26 of the first and second cavity 12, 22 wherein the enclosing surfaces 42, 52 of the sensors 40, 50 are arranged with a thread and the interior sidewalls 16, 26 of the cavities 12, 22 comprises a corresponding thread, for screw attachment of the sensors 40, 50 to the barbell 1.

Another embodiment may be that the sensors 40, 50 are retained in the respective cavities 12, 22 by magnets and corresponding magnetic material, wherein either a bottom 46, 56 of the sensors 40, 50 or the dividers 15, 25 comprise the magnet or vice versa.

Yet another embodiment may be that the sensors 40, 50 are arranged for bayonet engagement with the interior sidewalls 16, 26 of the cavities 12, 22 by that the enclosing surfaces 42, 52 of the sensors 40, 50 are arranged with first bayonet means and the interior sidewalls 16, 26 of the cavities 12, 22 comprise a corresponding second bayonet means arranged for cooperation with the first bayonet means of the sensors 40, 50.

Although the description above contains a plurality of specificities, these should not be construed as limiting the scope of the concept described herein but as merely providing illustrations of some exemplifying embodiments of the described concept. It will be appreciated that the scope of the presently described concept fully encompasses other embodiments which may become obvious to those skilled in the art, and that the scope of the presently described concept is accordingly not to be limited. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein and are intended to be encompassed hereby.

The invention claimed is:

1. A barbell comprising:

a first bar part and a second bar part each arranged for carrying one or more weights, the first bar part and the second bar part extending along a longitudinal axis, a central bar part arranged between the first and the second bar parts, the central bar part is connected to the first bar part and the second bar part, the central bar part extending along the longitudinal axis, wherein the barbell is a straight barbell with a common longitudinal axis, wherein at least one of the first bar part and the second bar part comprises a cavity, at least one sensor arranged for registration of movements of the barbell and for wireless communication with a data analyzing unit, wherein the at least one sensor is arranged in the cavity, wherein an enclosing side surface of the at least one sensor faces an interior sidewall of the cavity, and wherein the enclosing surface of the at least one sensor is arranged to engage with the interior sidewall of the cavity for retaining the at least one sensor in the cavity, wherein the interior sidewall of the cavity comprises at least one recess which comprises one seal arranged for retaining the at least one sensor in the cavity by friction force between the seal and the enclosing side surface of the at least one sensor.

2. The barbell according to claim 1, wherein the first bar part extends between a first end connected to the central bar part and a free second end, and the second bar part extends between a first end connected to the central bar part and free second end, and the cavity is arranged at the free second end of the first or second bar part.

3. The barbell according to claim 2, wherein at least one of the first bar part and the second bar part is a hollow tube, and the central bar part extends into the hollow tube a distance that is shorter than a length of the hollow tube thereby leaving a free space at the free second end of the hollow tube, the free space constituting the cavity for the at least one sensor.

4. The barbell according to claim 1, wherein the first bar part comprises a first cavity and the second bar part comprises a second cavity, and the at least one sensor comprises a first sensor arranged in the first cavity and a second sensor arranged in the second cavity.

5. The barbell according to claim 1, wherein a depth of the cavity along the longitudinal axis exceeds a height of the at least one sensor such that the at least one sensor fits inside the cavity and thereby is protected inside the cavity.

6. A barbell comprising:

a first bar part and a second bar part each arranged for carrying one or more weights, the first bar part and the second bar part extending along a longitudinal axis, a central bar part arranged between the first and the second bar parts, the central bar part is connected to the first bar part and the second bar part, the central bar part extending along the longitudinal axis, wherein the barbell is a straight barbell with a common longitudinal axis, wherein at least one of the first bar part and the second bar part comprises a cavity, at least one sensor arranged for registration of movements of the barbell and for wireless communication with a data analyzing unit, wherein the at least one sensor is arranged in the cavity, wherein an enclosing side surface of the at least one sensor faces an interior sidewall of the cavity, and wherein the enclosing surface of the at least one sensor is arranged to engage with the interior sidewall of the cavity for retaining the at least one sensor in the cavity, wherein the at least one sensor is arranged for threaded engagement with the interior sidewall of the cavity by that the enclosing surface of the at least one sensor is arranged with a first thread and the interior sidewall of the cavity comprises a corresponding second thread arranged for cooperation with the first thread of the at least one sensor.

7. A barbell comprising:

a first bar part and a second bar part each arranged for carrying one or more weights, the first bar part and the second bar part extending along a longitudinal axis, a central bar part arranged between the first and the second bar parts, the central bar part is connected to the first bar part and the second bar part, the central bar part extending along the longitudinal axis, wherein the barbell is a straight barbell with a common longitudinal axis, wherein at least one of the first bar part and the second bar part comprises a cavity, at least one sensor arranged for registration of movements of the barbell and for wireless communication with a data analyzing unit, wherein the at least one sensor is arranged in the cavity, wherein the first bar part extends between a first end connected to the central bar part and a free second end, and the second bar part extends between a first end connected to the central bar part and free second end, and the cavity is arranged at the free second end of the first or second bar part, wherein at least one of the first bar part and the second bar part is a hollow tube, and the central bar part extends into the hollow tube a distance that is shorter than a length of the hollow tube thereby leaving a free space at the free second end of the hollow tube, the free space constituting the cavity for the at least one sensor, and wherein a short distance of the hollow tube is available at the free end of the bar part, and the short distance of the hollow tube is divided from a longer distance of the hollow tube by a divider, wherein the divider constitutes a bottom of the cavity, and when the at least one sensor is inserted into the cavity from the free end and a bottom of the at least one sensor is close to the divider, wherein the at least one sensor is retained in the cavity by a magnet and corresponding magnetic material, wherein either the bottom of the at least one sensor or the bottom of the cavity comprises the magnet and the one of the bottom of the at least one sensor or the bottom of the cavity that does not comprise the magnet comprises the magnetic material.

8. A barbell comprising:

a first bar part and a second bar part each arranged for carrying one or more weights, the first bar part and the second bar part extending along a longitudinal axis, a central bar part arranged between the first and the second bar parts, the central bar part is connected to the first bar part and the second bar part, the central bar part extending along the longitudinal axis, wherein the barbell is a straight barbell with a common longitudinal axis, wherein at least one of the first bar part and the second bar part comprises a cavity, at least one sensor arranged for registration of movements of the barbell and for wireless communication with a data analyzing unit, wherein the at least one sensor is arranged in the cavity, wherein the first bar part extends between a first end connected to the central bar part and a free second end, and the second bar part extends between a first end connected to the central bar part and free second end, and the cavity is arranged at the free second end of the first or second bar part, wherein at least one of the first bar part and the second bar part is a hollow tube, and the central bar part extends into the hollow tube a distance that is shorter than a length of the hollow tube thereby leaving a free space at the free second end of the hollow tube, the free space constituting the cavity for the at least one sensor, and wherein a short distance of the hollow tube is available at the free end of the bar part, and the short distance of the hollow tube is divided from a longer distance of the hollow tube by a divider, wherein the divider constitutes a bottom of the cavity, and when the at least one sensor is inserted into the cavity from the free end and a bottom of the at least one sensor is close to the divider and an opposite outer end of the at least one sensor is just inside the free end, wherein the at least one sensor comprises grooves at the outer end, which grooves are arranged for cooperation with a dismounting tool for dismounting of the at least one sensor from the cavity.

* * * * *